United States Patent [19]

Hilzinger et al.

[11] Patent Number: 5,037,494

[45] Date of Patent: Aug. 6, 1991

[54] AMORPHOUS ALLOY FOR STRIP-SHAPED SENSOR ELEMENTS

[75] Inventors: Hans R. Hilzinger, Langenselbold; Giselher Herzer, Hanau, both of Fed. Rep. of Germany

[73] Assignee: Vacuumschmelze GmbH, Fed. Rep. of Germany

[21] Appl. No.: 523,176

[22] Filed: May 15, 1990

Related U.S. Application Data

[63] Continuation of Ser. No. 192,608, May 11, 1988, abandoned.

[30] Foreign Application Priority Data

May 21, 1987 [DE] Fed. Rep. of Germany ..... 3717043

[51] Int. Cl.[5] ..... H01F 1/04

[52] U.S. Cl. ..... 148/304; 148/403; 420/435; 420/440; 420/441; 420/452; 420/459

[58] Field of Search ..... 148/304, 403; 420/435, 420/440, 441, 452, 459

[56] References Cited

U.S. PATENT DOCUMENTS

| | | | |
|---|---|---|---|
| 4,188,211 | 2/1980 | Yamaguchi et al. | 148/304 |
| 4,225,339 | 9/1980 | Inomata et al. | 148/403 |
| 4,416,709 | 11/1983 | Ohya et al. | 148/304 |
| 4,439,236 | 3/1984 | Ray | 148/403 |
| 4,484,184 | 11/1984 | Gregor et al. | 340/572 |

FOREIGN PATENT DOCUMENTS

| | | | |
|---|---|---|---|
| 0017801 | 10/1980 | European Pat. Off. . | |
| 0072574 | 2/1983 | European Pat. Off. | 148/304 |
| 0121649 | 10/1984 | European Pat. Off. . | |
| 0160166 | 10/1985 | European Pat. Off. | 148/304 |
| 53-103924 | 9/1978 | Japan | 148/304 |
| 60-70157 | 4/1985 | Japan | 148/304 |
| 61-64861 | 4/1986 | Japan | 148/304 |
| 8201080 | 10/1982 | Netherlands | 148/304 |

OTHER PUBLICATIONS

Amorphous Metals Vitrovac Alloys and Applications, PV-006, Jul. 1989.

Applications of Amorphous Soft Magnetic Materials, H. Warlimont and R. Boll, Journal of Magnetism & Magnetic Material 26 (1982).

The Impact of Amorphous Metals on the Field of Soft Magnetic Materials, Hans Warlimont, vol. 99, Mar. 1988.

*Primary Examiner*—John P. Sheehan

*Attorney, Agent, or Firm*—Hill, Van Santen, Steadman & Simpson

[57] ABSTRACT

An amorphous alloy free of magnetostriction is employed in anti-theft labels, magnetic field detectors or the like, having a saturation induction of $B_s \leqq 0.5T$ and a good responsiveness given an annealing treatment in the magnetic field for achieving a remanance relationship of $B_r/B_s > 0.6$.

4 Claims, No Drawings

AMORPHOUS ALLOY FOR STRIP-SHAPED SENSOR ELEMENTS

This is a continuation of application Ser. No. 192,608, filed May 11, 1988 now abandoned.

BACKGROUND OF THE INVENTION

1. Field of the Invention

The invention is directed to an amorphous alloy for strip-shaped sensor elements having low saturation induction for employment in anti-theft labels, magnetic field detectors or the like.

2. Description of the Prior Art

Thin strips of a material having a very low retentivity are required for anti-theft labels Commercially available strips of both crystalline and amorphous material have been employed for this purpose. The standard dimensions for such strips are a ribbon width of less than 3 mm, a ribbon thickness of less than 40 μm, and a label length of 50–100 mm, or below in individual cases. Important for the functioning of such strips is that the material can be completely magnetized, or remagnetized with optimally low exciting magnetic fields. As a result of the non-linearity of the magnetization curve of the strip when the magnetic saturation is reached, then upper harmonics (for example) of the excitation frequency are generated in a corresponding receiver coil of an anti-theft system given re-magnetization, these upper harmonics serving the purpose of detecting the strip, and thus a possible theft.

That field strength $H_S$ needed for completely magnetizing the strip is essentially determined by the geometry of the strip (magnetic shearing effect) and by the magnetic anisotropy energy transversely relative to the strip direction. The following relation is valid in strip direction:

$$H_S = \frac{aw \cdot t}{l^2} \cdot B_S + H_A$$

wherein w denotes the width, $t^l$ denotes the thickness, l denotes the length of the strip, $B_S$ denotes the saturation induction and $H_A$ denotes the magnetic anisotropy field. The factor a is likewise dependent on the strip geometry, though only to a slight degree, and can be essentially considered to be a constant.

In order to arrive at a detectable, significant signal, the magnetic excitation field strength in the customary systems must be roughly on the order of magnitude of, or greater than, the saturation field strength $H_S$ insofar as possible. The excitation field strength can not, however, be excessively high for several reasons, for example, to avoid false alarms due to other ferro-magnetic articles, for reasons of power consumption for the excitation field strength, for reducing unnecessary losses, or for heating.

Similar conditions are frequently present in magnetic field sensors for the acquisition of magnetic fields as well. The sensitivity of these sensors generally increases with increasing strip length, wherein a uniformity of the aforementioned equation is also critical.

The demagnetizing field is noticeably diminished in the strip direction according to the above equation on the basis of the specific selection of the strip geometry, i e. low width and thickness and relatively long label length This has the desired effect that the magnetic strip can be re-magnetized in relatively low excitation fields, and thus supplies the desired signal.

The saturation field strength $H_S$ reduced even more by specific heat treatments, which cause the anistropy field $H_A$ to nearly disappear. This, for example, is the case for magnet material having an intrinsically rectangular magnetication loop, for which reason such a material has proven especially suitable in many cases.

The optimization of the magnetic strips for anti-theft labels hitherto ensued by adapting the geometry and by heat treatment of commercially available magnetic material, whereby the heat treatment ensues in the magnetic field parallel to the longitudinal axis of the band.

Problems, however, arise when the available space and, thus, the strip length l is limited for spatial reasons (for example, miniaturization). In order to nonetheless obtain a low shearing field in such cases, $w \cdot t \cdot B_S$ (cf. the equation) must be correspondingly reduced. This can be achieved to a certain degree by reducing width w and thickness t. Given extremely small widths and thicknesses, however, increasing problems arise in the manufacture and manipulation of ribbon (or of wire) having such a slight cross-section.

SUMMARY OF THE INVENTION

It is an object of the present invention is to provide an amorphous alloy with which the length of the strip-shaped sensor elements can also be diminished as needed for miniaturization, while maintaining the desired function and reliability.

This object is achieved in accordance with the principles of the present invention by an amorphous alloy free of magnetostriction that has a saturation induction of $B_S \leqq 0.5T$ and that has a good responsiveness given an annealing treatment in a magnetic field for achieving a remanance relationship of $B_r/B_S > 0.6$.

The present invention is based on the perception that the saturation field strength $H_S$ such specific applications can be achieved not only by reducing the cross-section, but also by reducing the saturation magnetization. The known, commercially available alloys in the field of the invention all have a saturation magnetication $B_S$ of greater than 0.5. For example, European Application 0,121,694 teaches the saturation magnetization is far greater than 0.5T, and that it is especially advantageous when the saturation magnetization has a value equal to or greater than 1T.

A lowering of the saturation induction can always be achieved by diluting known compositions with magnetically inactive atoms. Such alloys, however, having low $B_S$, frequently do not respond in the desired way in a heat treatment in the magnetic field. A good responsiveness to a heat treatment in the longitudinal field is, however, required in order to achieve a Z-shaped loop having a required remanance relationship of $B_r/B_S > 0.6$.

DESCRIPTION OF THE PREFERRED EMBODIMENTS

Responsiveness to heat treatment in the longitudinal field is especially well-established given low-magnetostriction, amorphous alloys having a Co base. Nickel and, in part, niobium as well have proven to be especially beneficial alloying elements for lowering $B_S$ without thereby abandoning the required responsiveness to the heat treatment. Iron or manganese can usually be used for setting low magnetostriction values in cobalt alloys. It has then been additionally shown that iron yields significantly better results, i.e. good responsiveness to magnetic field treatments, than manganese.

The conditions regarding saturation induction and remanance relationship can be achieved with an amorphous alloy of the invention that is characterized by the following sum formula:

$$Co_{100-u-x-y-z}Fe_uNi_x(Nb+T)_y(Si+B)_z, \text{ wherein}$$

$u$=4–10 At. %
$x$=20–50 At. %
$y$=0–18 At. %
$z$=5–30 At. % and
$x+5.3\,y+4.1\,z-0.73\,u=120$ through 135, $z+y>20$ At. % and
$Nb+B>6$At. %. The component T consists of an element from the group of Mo, Cr, V, Zr, Ti, W, or mixtures of these elements in a range of 0At. % to 3 At. % (relative to the overall alloy) on a case-by-case basis.

A particularly advantageous amorphous alloy has $u$=4 through 10 At. %, $x$−20 through 45 At. %, $y=o$ through 4 At. %, $z$=20 through 30 At. %, and $x+5.3\,y+4.1\,z-0.73\,u=120$ through 130.

An advantageous modification of this alloy has $u$=4 through 10 At. %, $x$=20 through 30 At. %, $y$=12 through 18 At. %, $z$=5 through 12 At. % and $x+5.3\,y+4.1\,z-0.73\,u=120$ through 130.

Another advantageous modification has $u$=4 through 10 At. %, $x$=35 through 45 At. %, $y$=0 through 1 At. % and $z$=21 through 23 At. %.

The following table reproduces the results of a number of alloys that were subjected to a heat treatment in the longitudinal field. For economic reasons, such a heat treatment should not last too long, i.e. should be shorter than about one day and should nonetheless achieve a remanance relationship $B_r/B_s>0.6$.

The Table shows that the alloys 1–6 in fact exhibit a saturation induction in the desired range, but they do not adequately respond to a heat treatment at all temperatures employed (i.e. a desired remanance relationship $B_r/B_s>0.6$ was not capable of being achieved). A number of alloys such as, for example $Co_{58}Ni_{10}Fe_5Si_{11}B_{10}$ ($B_s$ = 0.57$T$)

$Co_{67}Fe_4Mo_{1.5}Si_{6.5}B_{11}$ ($B_s$ = 0.57$T$)

$Co_{70}Fe_5Si_{15}B_{10}$ ($B_s$ = 0.75$T$)

$Fe_{40}Ni_{40}B_{20}$ ($B_s$ = 1.0$T$)

are known that in fact respond well to a heat treatment ($B_r/B_s>0.6$ can be achieved), but all have $B_s>0.5$T and thus do not come into consideration for the applications desired here. Alloys 7 through 11 are suitable, these achieving both $B_s>0.5$T and $B_r/B_s>0.6$.

| | | Remanance Relationship as Quenched and After 20 Hours Heat Treatment In The Longitudinal Field at the Indicated Annealing Temperatures | | | | | |
|---|---|---|---|---|---|---|---|
| Alloy | $B_s$ (T) | as quenched | 100° C. | 110° C. | 120° C. | 130° C. | 150° C. |
| 1. $Fe_{18.5}Ni_{58.5}B_{23}$ | 0.49 | 0.35 | 0.36 | 0.32 | 0.30 | 0.29 | 0.30 |
| 2. $Fe_{23}Ni_{52}B_{25}$ | 0.35 | 0.44 | 0.49 | 0.43 | 0.44 | 0.41 | 0.51 |
| 3. $Co_{66.5}Fe_{3.5}Mo_2Si_{18}B_{10}$ | 0.39 | 0.34 | 0.27 | 0.26 | 0.31 | 0.23 | 0.31 |
| 4. $Co_{65.5}Fe_{3.5}Mo_2Si_{17}B_{12}$ | 0.43 | 0.22 | 0.21 | 0.17 | 0.22 | 0.27 | 0.22 |
| 5. $Co_{70.3}Fe_{1.8}Ni_{4.3}Nb_{17.2}B_{6.4}$ | 0.41 | 0.18 | 0.19 | 0.17 | 0.20 | 0.21 | 0.22 |
| 6. $Co_{67.1}Fe_{1.8}Ni_{6.5}Nb_{18.5}B_{6.1}$ | 0.34 | 0.27 | 0.31 | 0.36 | 0.31 | 0.25 | 0.18 |
| 7. $Co_{31}Ni_{40}Fe_7Si_{13}B_9$ | 0.41 | 0.44 | 0.81 | 0.81 | 0.77 | 0.69 | 0.38 |
| 8. $Co_{51}Ni_{22.5}Fe_5Nb_{14.5}B_7$ | 0.40 | 0.48 | 0.58 | 0.77 | 0.65 | 0.80 | 0.86 |
| 9. $Co_{31.6}Ni_{39.3}Fe_7Si_{13.2}B_{8.9}$ | 0.43 | | | | 0.72 | 0.81 | 0.77 |
| 10. $Co_{33.5}Ni_{37.5}Fe_7Si_{13.5}B_{8.5}$ | 0.46 | | | | 0.87 | 0.95 | 0.95 |
| 11. $Co_{34.1}Ni_{36.8}Fe_7Si_{13.9}B_{8.2}$ | 0.50 | | | | 0.85 | 0.93 | 0.93 |

Although modifications and changes may be suggested by those skilled in the art it is the intention of the inventors to embody within the patent warranted hereon all changes and modifications as reasonably and properly come within the scope of their contribution to the art.

We claim as our invention:

1. A heat treated amorphous alloy for strip-shaped sensor elements having low saturation induction, being free of magnetostriction, having a saturation induction of $B_s \leqq 0.5$ T and having responsiveness in an annealing treatment in a magnetic field for achieving a remanence relationship of $B_r/B_s<0.06$ having the formula $Co_{100-u-x-y-z}Fe_uNi_x(Nb+T)_y(Si+B)_z$wherein $u$=4 through 10 At. %, $x$=20 through 50 At. %,$y$=0 through 18 At. %,$z$=5 through 30 At. %, $x+5.3y+4.1z-0.73\,u=120$ through 135, $z+y>20$ At. %, Nb+B>6 At. % and T=0 through 3 At. % of an element selected from the group consisting of Mo, Cr, V, Zr, Ti, W or a mixture of the elements in said group.

2. An amorphous alloy as claimed in claim 1, wherein $u$ =4 through 10 At. %, $x$=20 through 45 At. %, $y$=0 through 4 At. %, $z$=20 through 30 At. % and $x+5.3\,y+4.1\,z-0.73\,u=120$ through 130.

3. An amorphous alloy as claimed in claim 1, wherein $u$=4 through 10 At. %, $x$=20 through 30 At. %, $y$=12 through 18 At. %, $z$=5 through 12 At. % and $x+5.3\,y+4.1\,z-0.73\,u=120$ through 130.

4. An amorphous alloy as claimed in claim 2, wherein $u$=4 through 10 At. %, $x$=35 through 45 At. %, $y$=0 through 1 At. %, and $z$=21 through 23 At. %.

* * * * *